US006852070B1

(12) United States Patent
Herbert

(10) Patent No.: US 6,852,070 B1
(45) Date of Patent: Feb. 8, 2005

(54) BICYCLE

(76) Inventor: Dieter Herbert, Hammarkulletorget 14, Angered (SE), S-424 37

( * ) Notice: Subject to any disclaimer, the term of this patent is extended or adjusted under 35 U.S.C. 154(b) by 0 days.

(21) Appl. No.: 09/701,306

(22) PCT Filed: May 28, 1999

(86) PCT No.: PCT/SE99/00915

§ 371 (c)(1),
(2), (4) Date: Nov. 28, 2000

(87) PCT Pub. No.: WO99/62600

PCT Pub. Date: Dec. 9, 1999

(30) Foreign Application Priority Data

May 29, 1998 (SE) ..... 9801916

(51) Int. Cl.[7] ..... A63B 69/00

(52) U.S. Cl. ..... 482/57; 482/63

(58) Field of Search ..... 482/51–53, 57–65

(56) References Cited

U.S. PATENT DOCUMENTS

| | | | | |
|---|---|---|---|---|
| 4,477,072 A | * | 10/1984 | DeCloux | 482/4 |
| 4,550,906 A | | 11/1985 | Im | |
| 5,433,680 A | | 7/1995 | Knudsen | |
| 5,496,238 A | * | 3/1996 | Taylor | 482/63 |
| 5,735,774 A | | 4/1998 | Maresh | |

* cited by examiner

*Primary Examiner*—S. R. Crow
(74) *Attorney, Agent, or Firm*—Young & Thompson

(57) ABSTRACT

A bicycle includes a frame and a wheel rotatably mounted in relation thereto. The wheel is drivable by two pedal devices including pedal-equipped arms. The two pedal devices are individually mounted in different bearings and connected to the wheel via two different transmissions, which separately co-operates with a mechanical clutch. The clutch includes a dog being movable to and from opposite shoulder surfaces of which a first one guarantees driving the wheel when the dog, in an active state, is pressed against the first shoulder, and the second shoulder gives rise to noise when the dog, in an inactive state, collides with the second shoulder.

5 Claims, 3 Drawing Sheets

BICYCLE

TECHNICAL FIELD OF THE INVENTION

This invention relates to a bicycle of the type that comprises a frame and a wheel rotatably mounted in relation thereto, which wheel is drivable by means of two pedal devices having pedal-equipped arms.

BACKGROUND OF THE INVENTION

In previously known training bicycles, which in more modern versions frequently are used for so called spinning, the two pedal devices are oriented in 180° to each other and rigidly united to a mutual shaft to which a chain wheel for one single transmission in the form of an endless chain is rigidly united, which transmits the driving power to the wheel, which power the exercising person applies to the pedals via his/her legs. In practice, this construction gives a mediocre and partly monotonous training of the body. Thus, energy demanding power transmission from the legs of the user to each individual pedal device takes place in the main only the half revolution during which the pedal device is brought to move in the direction forwards from the area of an upper dead centre to the area of a lower dead centre. During the return movement backwards from the lower dead centre towards the upper dead centre, the individual leg is, however, kept in all essentials in a position of rest so far that the same inactively accompanies the pedal in question when the other leg depresses the opposite pedal. This pattern of movement results in a low physiological degree of efficiency, inasmuch as the individual leg's own weight (which frequently is within the range of 15–25 kg) contributes to apply the individual pedal force during the single movement which requires marked energy consumption, viz. the depression, as well as inasmuch as only certain muscle groups in, above all, the exercising person's legs, back and stomach need to be activated during the movement of depression, viz. the muscles which can apply the pedal compressive force.

OBJECTS AND FEATURES OF THE INVENTION

The present invention aims at obviating the above-mentioned shortcomings of previously known bicycles and at providing an improved bicycle. Thus, a primary object of the invention is to provide a bicycle which enables a more all-round training and which, by simple means, draws the user's attention to such moments when the work of the body is not carried out in a physiologically optimum way.

According to the invention, the above-mentioned object is attained by the features defined herein.

BRIEF DESCRIPTION OF THE APPENDED DRAWINGS

DETAILED DESCRIPTION OF A PREFERRED EMBODIMENT OF THE INVENTION

Figure 1:
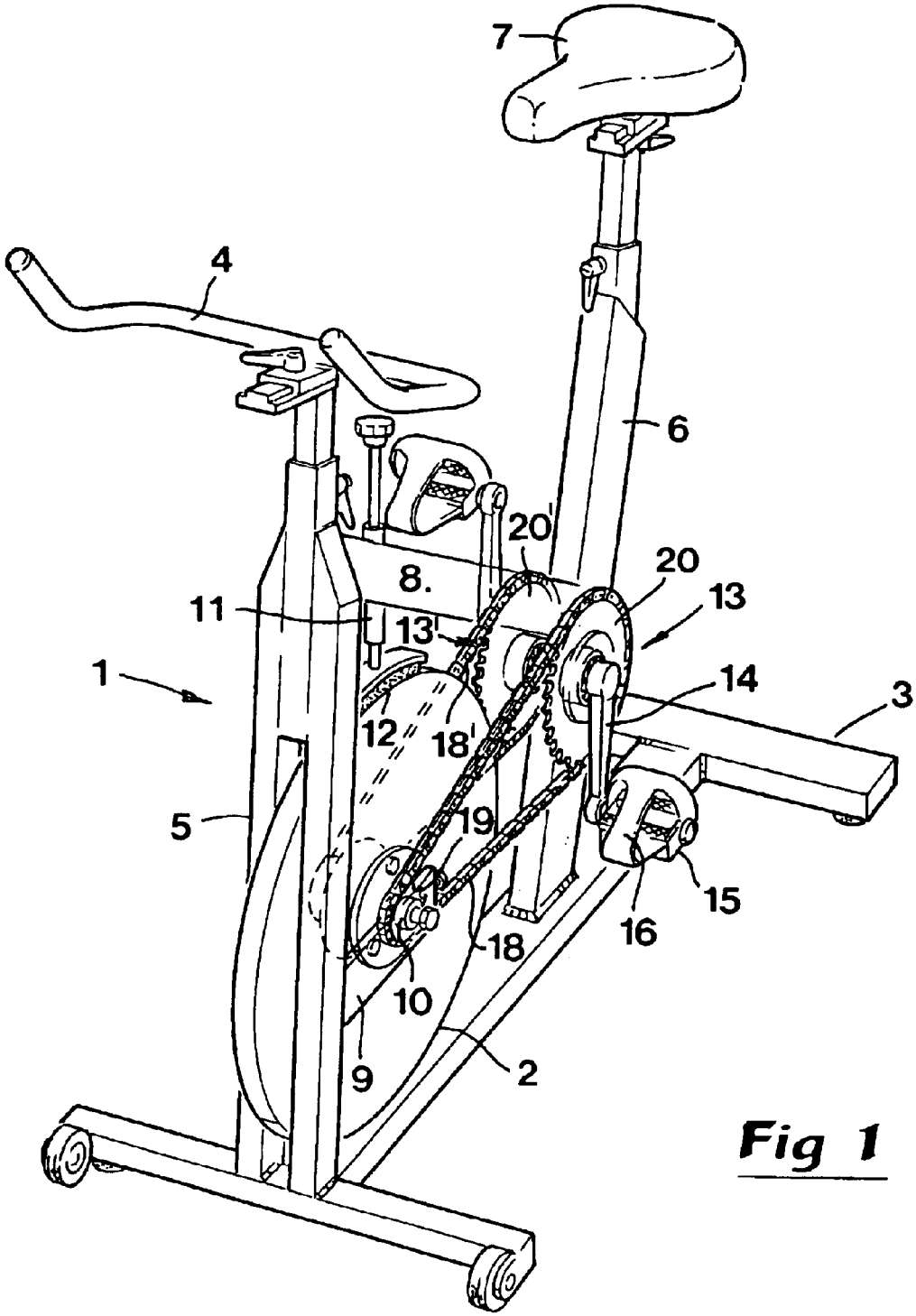
FIG. 1 is a perspective view of the bicycle according to the invention.

The bicycle shown in FIG. 1 comprises a frame in its entirety designated 1 as well as a wheel 2 in the shape of a balance wheel rotatably mounted in relation thereto. The frame 1 is composed of a base 3, a front fork 5 provided with a support handle 4, as well as a rear upright 6 which carries a saddle 7. An intermediate piece 8 extends between the front fork 5 and the upright 6. Schematically outlined brackets 9 carrying a shaft 10 for the wheel 2 extend backwards from the two spaced-apart branches of the front fork. A brake device 11 mounted on the intermediate piece 8 has the purpose of applying a variable brake effect to the balance wheel. In the shown example, the brake device 11 includes a lining 12 acting against the periphery of the wheel, which lining may be pressed variously hard against the wheel by means of a screw.

In order to drive the wheel 2, a mechanism is arranged including two pedal devices 13, 13' each one of which having an arm 14 with an oblique pedal 15, more precisely a pedal of the type that includes a shackle 16 in which the front part of a user's foot may be engaged.

As far as the shown bicycle has been described hitherto, the same is in all essentials previously known.

Figure 2:
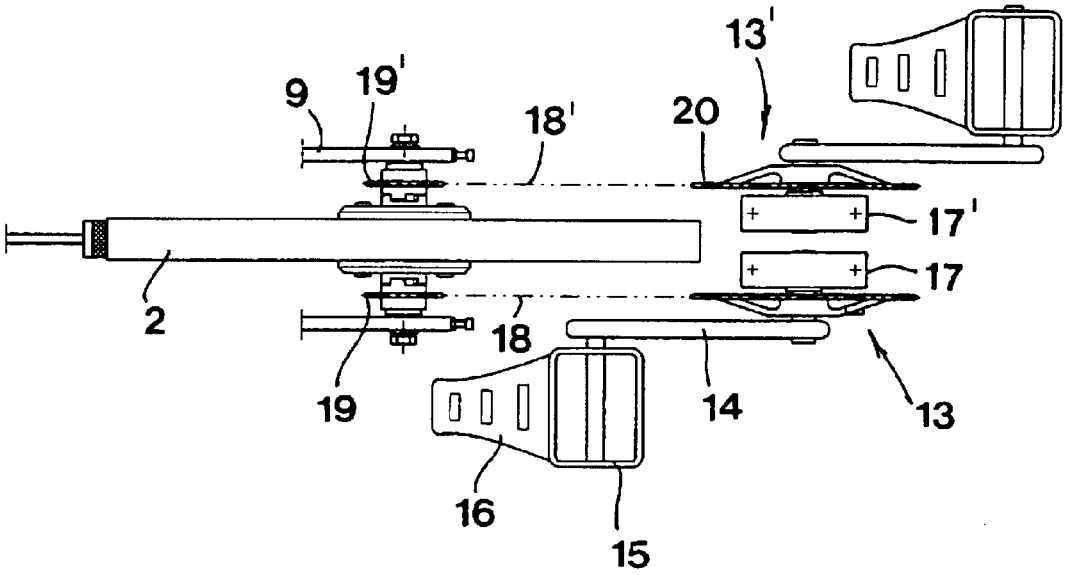
FIG. 2 is a partly cut planar view showing a pedal mechanism included in the bicycle together with a balance wheel.

New and characteristic for the bicycle according to the invention is that the two pedal devices 13, 13' are individually mounted in two various bearings 17, 17' (see FIG. 2) and connected to the balance wheel 2 via two different transmissions 18, 18'. In the shown example, these transmissions consist of endless chains, known per se, which in the front are in engagement with first toothed wheels or cog wheels 19, 19' and at the rear co-operate with second cog wheels 20, 20' included in the two pedal devices 13, 13'.

Figure 3:
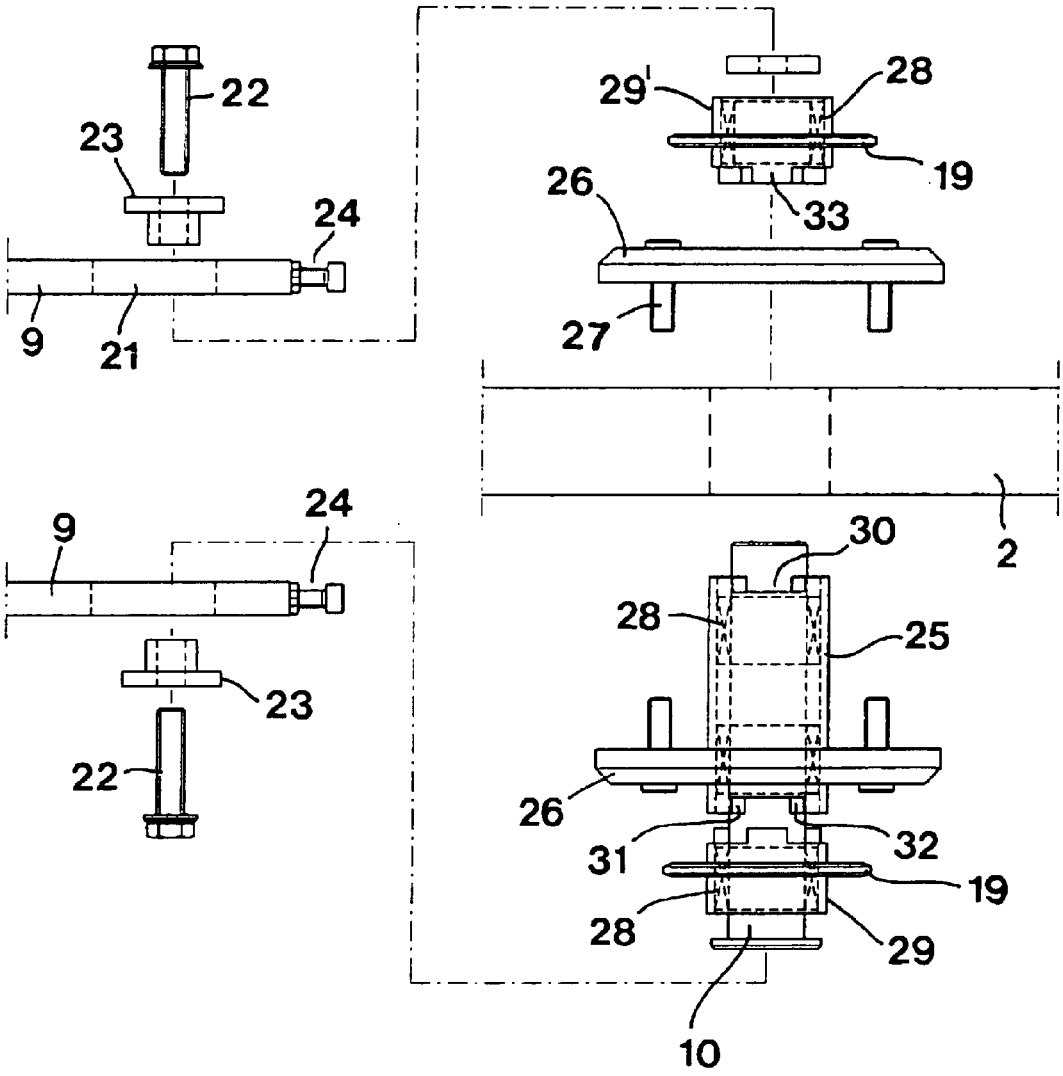
FIG. 3 is an enlarged exploded view showing a hub construction included in the balance wheel.

Reference is now made to FIG. 3, which in detail illustrates the hub construction of the balance wheel. The shaft 10 is insertable in holes 21 in the brackets 9 and fixable in relation thereto by means of screws 22 and washers 23. The position of the shaft may be finely adjusted by means of set screws 24. A tube piece 25 is rotatably mounted on the shaft 10, which piece is rigidly connected to the balance wheel 2 via flanged rings 26, being pressable against the wheel via nipples 27. Although the mounting of the tube piece 25 in relation to the shaft 10 may be realized in various ways, in practice needle bearings 28 are preferred for this purpose. Furthermore, at each end of the tube piece 25, two cages 29, 29' are rotatably mounted on the shaft 10 with which cages the two front chain wheels 19, 19' are rigidly connected. Also the cages 29, 29' are advantageously mounted on the shaft by means of needle bearings 28.

Figure 5:
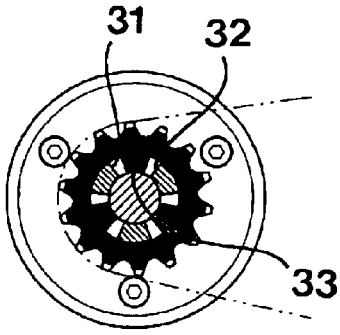
FIG. 5 is an analogous side view showing the same clutch in a second functional state.

In each one of the two end portions of the tube piece 25, a number of recesses 30 are provided which are separately delimited by tangentially spaced-apart, opposite shoulder surfaces 31, 32. Each such shoulder surface suitably extends radially in relation to the geometric centre axis of the shaft, i.e. perpendicularly to a tangent to the cylindric envelope surface of the shaft. In this manner, the recession gets a sector-like shape, as may be clearly seen in FIGS. 4 and 5. In the shown example, the tube piece includes three equidistantly spaced-apart recesses. In this case, the sector-shaped recession may, for instance, have an arc length within the range of 40–80°, suitably 50–70°.

A number of dogs or fingers 33 corresponding to the number of recesses 30 are provided on the inwardly turned end portion of each cage 29, 29'. Also these fingers 33 are cross-section-wise sector-shaped, although with an arc length which is smaller than the arc length of a co-operating recess 30 in which the finger engages. In practice, the individual finger may have a sector arc length which is 15–25° less than the arc length of the recession. Like the recessions 30, the fingers 33 are equidistantly spaced-apart. By the fact that the individual finger is smaller than the appurtenant recess, the individual cage 29 and 29', respectively, may move between opposite end positions in relation to the tube piece 25, viz. between an end position in which front shoulder surfaces on the fingers abut against front shoulder surfaces in the recessions and an opposite end position in which rear shoulder surfaces on the fingers abut against rear shoulder surfaces in the recessions.

THE FUNCTION AND ADVANTAGES OF THE INVENTION

The present invention is based on the understanding that physiologically optimal training results are only attained if the two legs of the exercising person continuously work entire revolutions, i.e. not only during the half revolution when the individual leg carries out a depression movement, but also during each subsequent return movement when the pedal is to be brought backwards from the lower dead centre thereof towards the upper dead centre thereof. Due to this reason, the two pedals of the bicycle according to the invention are equipped with means for fixation of the foot or shoe of the exercising person. In the shown example, the pedals 15 include a conventional shackle 16 in which the foot may be inserted. However, it is also feasible to form the pedal with other means for the same purpose, e.g. snap fasteners for the shoes of the exercising person. The essential thing is only that the foot may carry the pedal with it actively, not only during the depression phase but also during the return phase.

Figure 4:
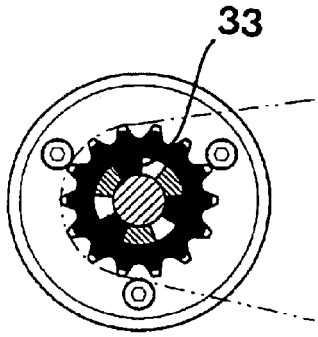
FIG. 4 is a side view of a clutch included in the hub construction in a first functional state.

Optimum body exercise is attained when the two legs of the user continuously apply driving power to the balance wheel 2. When one of the pedals, e.g. the one which is included in the pedal device 13 for the left leg of the user, is depressed, the appurtenant clutch in the hub construction of the balance wheel will transmit power to the balance wheel by the fact that the three carrier fingers 33 of the clutch cages 29 are pressed against the front shoulder surfaces 31 such as is illustrated in FIG. 4. If the right leg during the simultaneous return movement for the appurtenant pedal works actively, i.e. drives or lifts the pedal upwards, also the clutch cage 29' will work in the same way, i.e. the carrier fingers of the clutch cage 29' will be pressed against the front shoulder surfaces 31 in the appurtenant recesses 30. In doing so, also the right leg drives the balance wheel in an active manner. However, if the right leg would not be activated to the same extent as the left one, the clutch cage 29' will lag behind or be offset in phase in relation to the clutch cage 29 co-operating with the left leg. This results in that each individual carrier finger on the clutch cage 29' will move a distance backwards in the appurtenant recesses and, in a very short time, collide with the rear shoulder surfaces 32 of the recessions. As has been verified through tests made, this collision gives rise to a noise which is easily audible by the user. His/her attention is then paid, in a distinct way, to the fact that the leg in question does not work as active as the other leg. This is something which in turn gives a possibility to immediately correct this way of working, simply by applying more muscular power to the leg in question.

In practice, it should be most ordinary that the lifting leg will lag behind the depressing leg. However, the construction according to the invention also enables correction of the opposite conditions, if this peradventure would occur.

A substantial advantage of the bicycle according to the invention is that the same by way of simple, mechanical means provides opportunities for an all-round body exercise in that the user is made conscious if one of the legs does not work in an optimal way, whereby instantaneous correction may take place. In other words, opportunities are provided for an intensified training during which a plurality of additional muscle groups are activated apart from the ones which are required for only depressing a pedal during half a revolution.

FEASIBLE MODIFICATIONS OF THE INVENTION

The invention is not solely restricted to the described example of embodiment. Although the invention above has been described only in connection with an immovable cycle exerciser, the same may also apply in connection with multi-wheeled, movable bicycles, e.g. racing bicycles. In the last-mentioned case, the described construction may be used not only with the purpose of intensifying the muscle work of the body, but also with the purpose of increasing the driving of a wheel and thereby the top speed of the bicycle. In other words, the invention may also be used for achieving an improved degree of efficiency in the bicycle work as such. Although the two clutches between the chains and the wheel in the example are made with three dogs co-operating with as many recesses in the tube piece mounted on the shaft, also fewer dogs, e.g. only one, may be used. It should also be pointed out that other transmissions, e.g. V-belts, might be used instead of chains. The thinner dogs may also be provided on the centre tube piece and the wider recessions may be provided in the chain wheel-equipped cages. In conclusion, it should be mentioned that the individual mounting of the pedal devices in two spaced-apart bearings makes it possible to place the pedal devices at various levels. In this way, the bicycle may be used by people with a handicap relating to legs and feet, e.g. people with differently long legs. In doing so it is also feasible to make at least one of the bearings adjustable and fixable in various positions.

What is claimed is:

1. A bicycle comprising:

a frame;

a wheel rotatably mounted relative to said frame;

two pedal devices having pedal-equipped arms, said pedal devices drive said wheel and are individually mounted in a respective different bearing and are connected to the wheel via a respective different transmission; and a mechanical clutch that separately cooperates with each said respective transmission, said mechanical clutch comprises a respective dog being movable to and from respective opposite shoulder surfaces, the first one of said shoulder surfaces driving said wheel when the respective dog, in an active state, is pressed against said first one of said should surfaces, and a second one of said shoulder surfaces gives rise to noise when the respective dog, in an inactive state, collides with said second one of said shoulder surfaces.

2. The bicycle according to claim 1, wherein said respective dog is connected to a respective cage that cooperates with said respective transmission, each said respective cage is rotatably mounted relative to a central shaft of the wheel and engages a recess of a wheel part rigidly connected to the wheel and delimited between respective ones of said first and second shoulder surfaces.

3. The bicycle according to claim 2, wherein each said respective dog of each said respective cage has three fingers which engages a corresponding number of recesses in said wheel part.

4. The bicycle according to claim 1, wherein each said respective transmission comprises an endless chain which is in engagement with a respective first chain wheel connected to the clutch and a respective second chain wheel connected to a respective one of said two pedal devices.

5. The bicycle according to claim 3, wherein each said respective transmission comprises an endless chain which is in engagement with a respective first chain wheel connected to the clutch and a respective second chain wheel connected to a respective one of said two pedal devices.

* * * * *